US007534154B2

(12) United States Patent
Burston et al.

(10) Patent No.: US 7,534,154 B2
(45) Date of Patent: May 19, 2009

(54) WATER EVAPORATION MINIMIZATION

(75) Inventors: Ian Arthur Burston, Wantirna (AU); Raymond Walter Shaw, Carlton North (AU); Mark Donald Edward Coghill, Moonee Ponds (AU)

(73) Assignee: Technological Resources Pty. Limited, Melbourne, Victoria (AU)

( * ) Notice: Subject to any disclaimer, the term of this patent is extended or adjusted under 35 U.S.C. 154(b) by 0 days.

(21) Appl. No.: 10/593,320

(22) PCT Filed: Mar. 18, 2005

(86) PCT No.: PCT/UA2005/000380

§ 371 (c)(1),
(2), (4) Date: Feb. 22, 2007

(87) PCT Pub. No.: WO2005/090696

PCT Pub. Date: Sep. 29, 2005

(65) Prior Publication Data

US 2007/0275616 A1 Nov. 29, 2007

(30) Foreign Application Priority Data

Mar. 18, 2004 (AU) ..... 2004901445

(51) Int. Cl.
*B63B 35/85* (2006.01)
*E04H 4/00* (2006.01)

(52) U.S. Cl. ..... 441/136; 4/498

(58) Field of Classification Search ..... 441/136; 220/216–227; 4/498
See application file for complete search history.

(56) References Cited

U.S. PATENT DOCUMENTS 4,270,232 A 6/1981 Ballew
4,366,806 A * 1/1983 Acker ..... 126/565
4,875,466 A * 10/1989 Slonneger ..... 126/565
5,398,349 A 3/1995 Haberler

FOREIGN PATENT DOCUMENTS

DE 3927616 A 12/1990
WO WO 98/12392 A 3/1998

* cited by examiner

*Primary Examiner*—Jesus D Sotelo
(74) *Attorney, Agent, or Firm*—Miles & Stockbridge P.C.; David R. Schaffer, Esq.

(57) ABSTRACT

A floating water surface cover module, comprising a rim (1), and a shallow dome-shaped cover (2)extending from the top of the rim (1) and formed with a vent (3), the rim and cover being formed with shaped air-filled air-tight cavities (5) spaced around the rim (1) to provide buoyancy, the rim (1) and the cover (2) being configured so that one module will nest within another to form a stable stack.

15 Claims, 4 Drawing Sheets

WATER EVAPORATION MINIMIZATION

FIELD OF THE INVENTION

The present invention relates to the minimization of water evaporation from water and tailings storage facilities, and more particularly to floating water surface cover modules for use in providing a floating barrier which covers a substantial part of the surface of a water storage facility to minimize evaporation.

BACKGROUND OF THE INVENTION

The need to conserve water in many parts of the world to support increasing demands placed on water resources by growing populations competing with environmental requirements is becoming more evident with time. This has fuelled interest in ways to minimize evaporative losses from open storages.

Numerous suggestions to minimize evaporation involving the use of floating objects have been made in the past with different degrees of success and associated problems. While evaporative loss is known to be reduced by covering the surface of the water with a cover of plastic or like sheeting, and while such techniques are used with success in swimming pools, such arrangements have limited success with water storage facilities having large surface areas which are exposed to extreme weather conditions, and particularly high winds.

Other suggestions include the use of floating balls and other floating covers made from plastic sheeting. In a study conducted by one of the present inventors, floating water surface modules which cover most of the surface of the water have been determined to provide a practical solution for large water surface areas, as they are relatively stable in high winds.

A cover which may be used in the above way is disclosed in WO 98/12392, which shows a floating cover molded from a suitable plastic and having vertical sides and a domed cover, buoyancy being provided by a compartment extending across the corner between the sides and the cover. While the arrangement described may be capable, with some modification, of mass production, it has the disadvantage of not being able to be arranged in a stable stack for storage or distribution, thereby increasing storage and distribution costs when required in the quantities necessary to cover a large body of water, and rendering it less suitable as a mass production candidate.

SUMMARY OF THE INVENTION AND OBJECT

It is an object of the present invention to provide a floating water storage cover module which lends itself to economic mass production while avoiding the storage and transport problems outlined above.

The invention provides a floating water surface cover module comprising a rim portion and a cover portion, means for giving buoyancy to the module such that in use the rim portion is substantially submerged in the water, said cover portion being configured to define an air space above the water, said buoyancy means including at least one air-filled buoyancy pocket, said rim and/or cover and said pocket(s) being configured to allow the module to be nested within and stacked with like modules for storage or transportation.

By using air-filled buoyancy pocket(s) as the buoyancy means, the module can be molded from a suitable plastics material, or constructed from other suitable material, to enable commercially viable mass production, while the configuration of the rim and/or cover to allow stacking reduces handling and storage costs by simplifying the distribution process.

The cover portion is usually provided with an air vent to equalise the pressure in said air space between the cover and the surface of the water. The cover portion is in most cases at least slightly domed to facilitate water run off while not significantly interfering with stackability.

The rim portion is preferably circular to provide the most efficient coverage according to random stacking theory. While hexagonal, triangular and square profiles could be adopted, the randomness of the deployment of the modules onto the surface of the water means that accurate alignment is difficult to achieve. It has been found that a circular profile achieves a higher consistency of coverage of the surface of the water, and for this reason is preferred. In any event, it is believed to be preferable to leave at least a small part of the water surface exposed to maintain water quality.

The buoyancy means may include a multiplicity of discrete air-filled pockets spaced around the rim. In one form, open pockets can be formed in the plastic molding of the rim and cover portion with separate lids being attached to the rim and the cover after molding in such a way as to close the open pockets to thereby form the air-filled buoyancy means.

In one form described further below, the cover portion is formed with shaped indentations which receive the pocket defining portions of the rim and cover when the modules are stacked thereby reducing the height of a stack of modules.

The rim may be formed with an outwardly stepped lower portion which defines a ledge on which the lower edge of the rim rests when the modules are stacked.

DESCRIPTION OF PREFERRED EMBODIMENTS

In order that the invention may be more readily understood, an embodiment will now be described with reference to the accompanying drawings in which.

Figure 1:
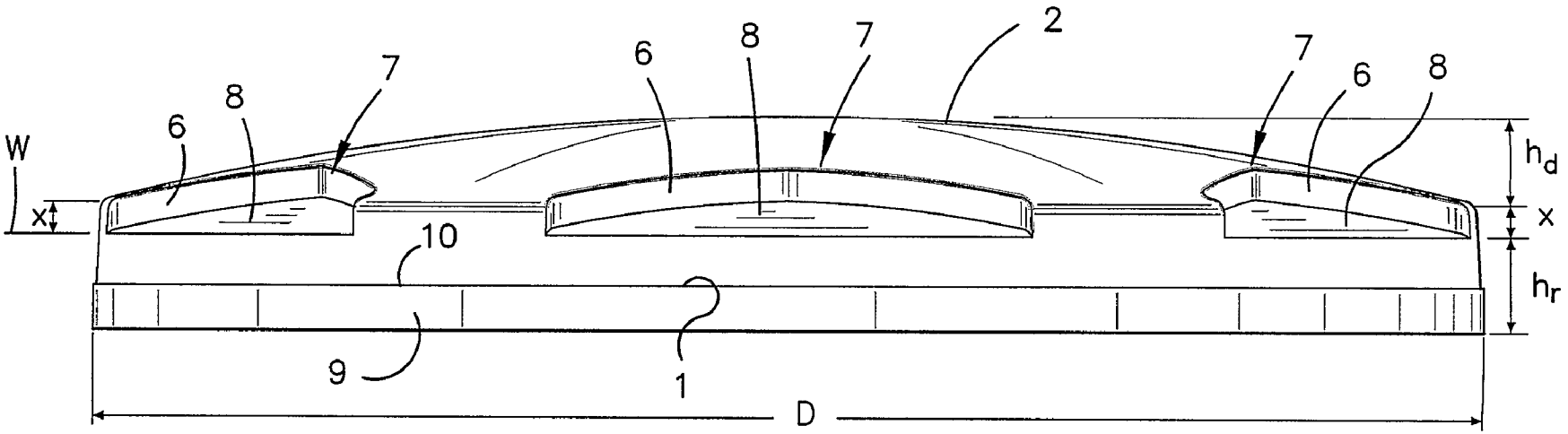
FIG. 1 is a side elevation of a module embodying the invention.
Figure 2:
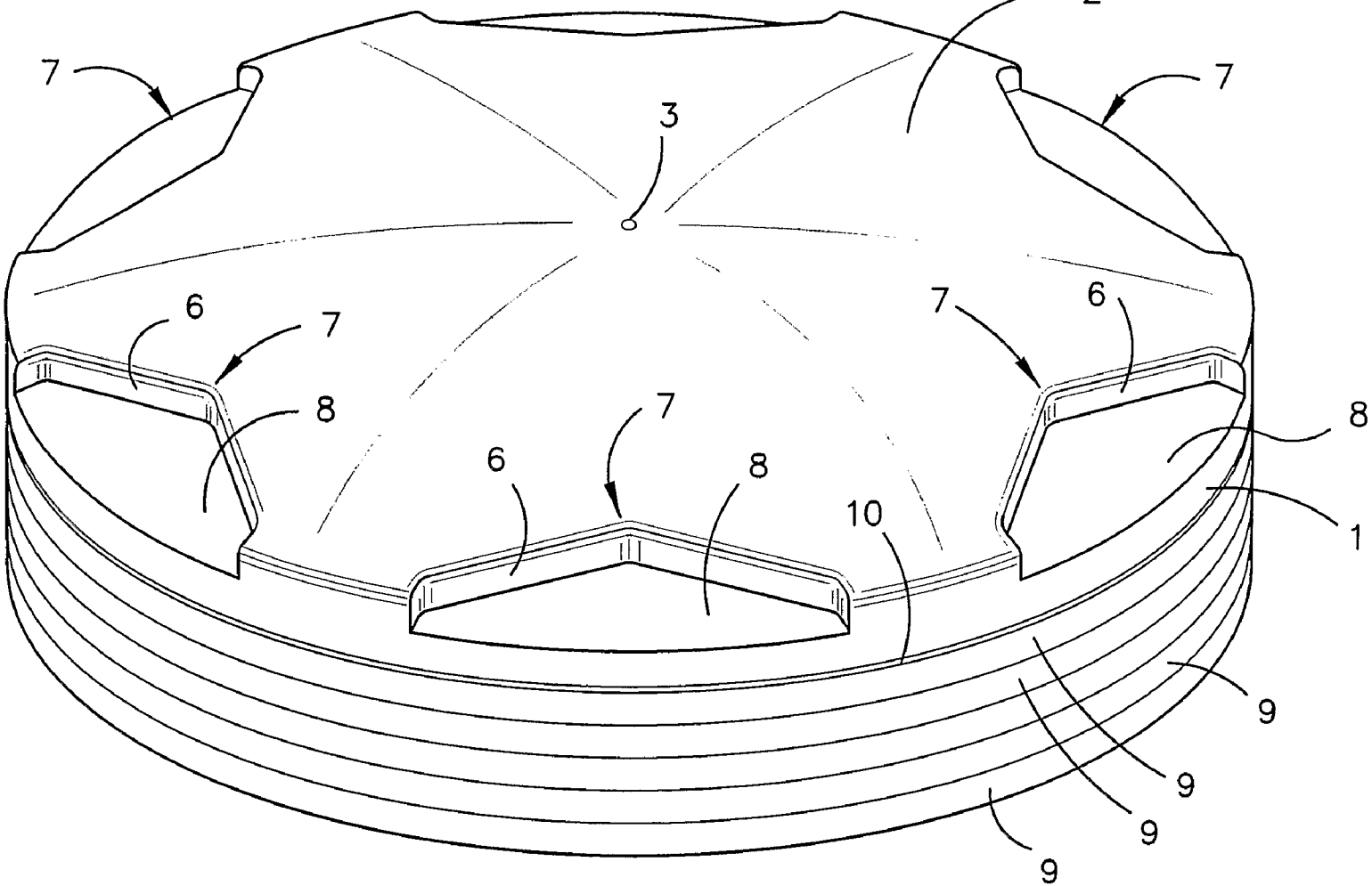
FIG. 2 is a perspective view from above of a stack of the modules of FIG. 1.
Figure 3:
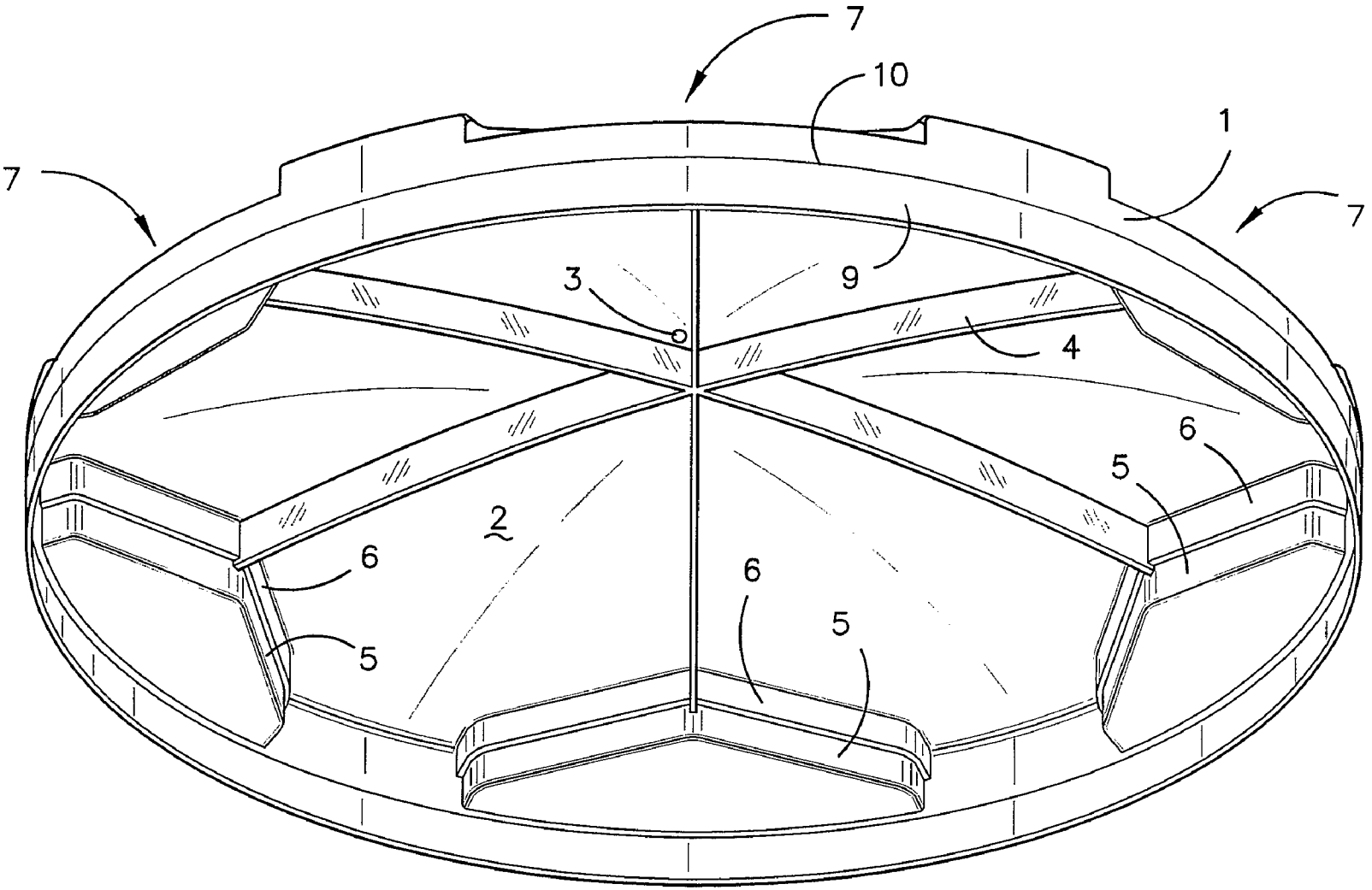
FIG. 3 is a perspective view from beneath of the module of FIG. 1.

Referring now to FIGS. 1 to 4 of the drawings, the floating water surface cover module has a rim 1, and a shallow domed cover 2, formed with a vent 3 of sufficient size to allow equalisation of the pressure of the air under the cover 2 when the module is immersed in water W as illustrated, while not allowing for the escape of a significant amount of water vapour. The module is suitably injection molded from a uv-treated plastic, such as polyurethane, and the underside of the module is formed with strengthening ribs 4 extending from the center of the cover 2 to the rim 1, as illustrated in FIG. 3 of the drawings.

To provide the module with the required buoyancy, it is formed with six shaped open topped cavities 5 which are closed at the top by six shaped lids 8 attached after molding to create air-tight, air-filled cavities 5. To allow for stacking, the lower portions of the cavities 5 are shaped to nest within walls 6 defining indentations 7 formed in the cover 2, the rims 1, cavities 5 and indentations 7 co-operating in the manner illustrated in FIG. 4 when the modules are stacked in the manner shown in FIG. 2. As will be noted from FIG. 4, the rim 1 has an outwardly stepped lower portion 9 defining a ledge 10 on which the lower edge of a stacked module rests with the cover 2 and the upper part of the rim 1 of a module nesting within a module stacked thereon as illustrated in FIG. 4.

Figure 4:
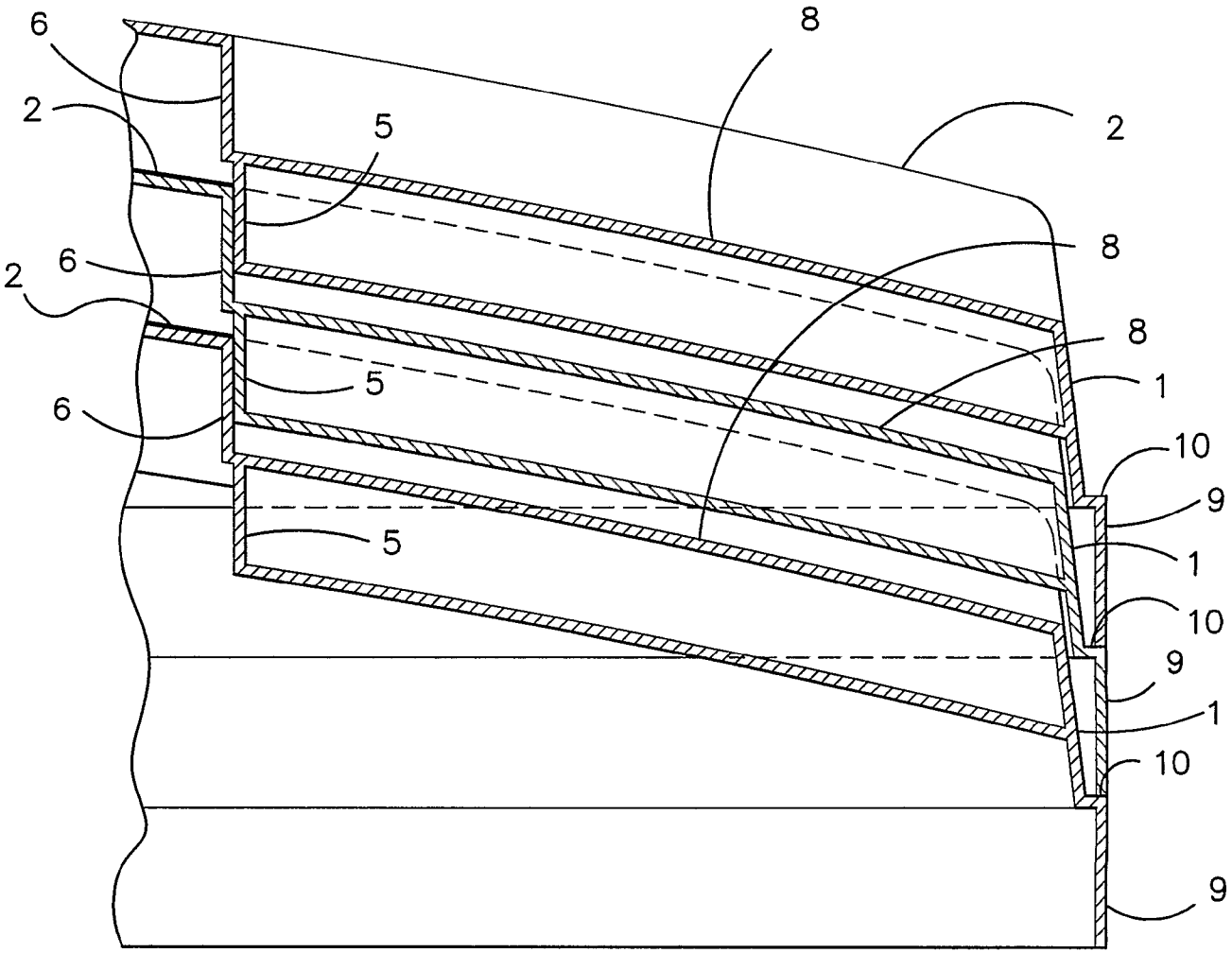
FIG. 4 is an enlarged fragmentary sectional elevation detailing the configuration the rims and indentations and how they cooperate when the modules are stacked as shown in FIG. 2.

The molding of the air cavities 5 with the rim and cover portion further strengthens the module and the cooperation between the cavities 5 and the indentations 7 and the stepped rims 1 of adjacent modules in a stack, ensures that each module is nested in and well supported when stacked as illustrated in FIGS. 2 and 4.

Each module sits in the water W as illustrated in Figure by the suitable selection of the buoyancy provided by the cavities 5. By ensuring that the rim 1 is immersed in this way, the module presents a low profile and is less likely to be tipped or otherwise disturbed during high winds.

In a preferred embodiment, the relationship between the height ($h_r$) of the rim and the depth ($\chi$) of the freeboard portion (portion not immersed in water) satisfies the relationship:

$$0.1 \leq \frac{x}{h_r} \leq 0.3 \tag{1}$$

If the relationship is greater than 0.3, this represents a condition where the bottom of the rim is more likely to come out of the water in rough conditions thereby making the module prone to being caught by the wind. At values less than 0.1, representing a normal water level close to the surface of the cover 2, water may splash onto the cover thereby increasing the water surface from which evaporation may occur.

In a typical embodiment, the diameter to height ratio of the rim ($D:h_r$) and the diameter to height ratio of the domed cover ($D:h_d$) are between 5:1 and 25:1.

The design parameters of the air-tight and air-filled cavities 5 and portions 6 and indentations 7 will be determined by the application of standard buoyancy theory and by subsequent field testing to arrive at a freeboard portion in use according to equation 1.

The embodiment described above satisfies the requirements of facilitating mass production and enabling efficient storage and distribution for use as a useful device for the minimisation of water evaporation from water storage facilities exposed to hostile environments.

The invention claimed is:

1. A floating water surface cover module for a water storage tailings facility comprising:

(a) rim portion;

(b) a plurality of closed air-filled buoyancy pockets spaced around the rim portion and associated with the rim and/or a cover portion for giving buoyancy to the module when in use such that the rim portion is substantially submerged in the water; and (c) the cover portion extending from the rim portion such that, when in use, the cover portion is spaced above the water and defines an air space between the cover portion and the water and the cover portion having indentations spaced around a perimeter of the cover portion and that nest with the closed air-filled buoyancy pockets of like modules when stacked.

2. The module of claim 1, wherein the rim portion has an outwardly stepped formation which allows the cover portion and part of the rim portion of one module to nest within an overlying module to form a stack.

3. The module of claim 2, wherein the cover portion is dome-shaped.

4. The module of claim 3, wherein the diameter to height ratio of the rim potion ($D:h_r$) and the diameter to height ratio of the dome shaped cover ($D:h_d$) are between 5:1 and 25:1.

5. The module of claim 2, wherein the cover portion has a vent opening to equalise air pressure in air space within the cover portion.

6. The module of claim 2, wherein the cover portion, rim portion and a substantial part of each air-filled pocket is a unitary plastic molding.

7. The module of claim 2, wherein the height ($h_r$) of the rim portion and the depth ($\chi$) of a freeboard portion satisfy the relationship:

$$0.1 \leq \frac{x}{h_r} \leq 0.3. \tag{1}$$

8. The module of claim 1, wherein the cover portion is dome-shaped.

9. The module of 8, wherein the diameter to height ratio of the rim portion ($D:h_r$) and the diameter to height ratio of the domed shaped cover ($D:h_d$) are between 5:1 and 25:1.

10. The module of claim 1, wherein the cover portion has a vent opening to equalise air pressure in air space within the cover portion.

11. The module of claim 1, wherein the cover portion, rim portion and a substantial part of each air-filled pocket is a unitary plastic molding.

12. The module of claim 1, wherein the height ($h_r$) of the rim portion and the depth ($\chi$) of the freeboard portion satisfy the relationship:

$$0.1 \leq \frac{x}{h_r} \leq 0.3. \tag{1}$$

13. A floating water surface cover module for a water storage tailings facility comprising:

(a) a rim portion; and (b) a cover portion, said cover portion being configured to define when in use an air space above the water with the rim portion partially submerged in the water;

(c) a plurality of closed air-filled buoyancy pockets spaced around the rim portion and associated with the rim portion and/or the cover portion for giving buoyancy to the module when in use; and (d) the cover portion extending from the rim portion such that, when in use, the cover portion is spaced above the water and defines said air space between the cover portion and the water and the cover portion having indentations spaced around a perimeter of the cover portion and that nest with the closed air-filled buoyancy pockets of like modules when stacked.

14. The module of claim 13, wherein the height ($h_r$) of the rim portion and the depth ($\chi$) of a freeboard portion satisfy the relationship:

$$0.1 \leq \frac{x}{h_r} \leq 0.3. \tag{1}$$

15. The module of claim 13, wherein the diameter to height ratio of the rim portion ($D:h_r$) and the diameter to height ratio of the domed cover portion ($D:h_d$) are between 5:1 and 25:1.

* * * * *

UNITED STATES PATENT AND TRADEMARK OFFICE

CERTIFICATE OF CORRECTION

PATENT NO. : 7,534,154 B2
APPLICATION NO. : 10/593320
DATED : May 19, 2009
INVENTOR(S) : Ian Arthur Burston, Raymond Walter Shaw and Mark Donald Edward Coghill It is certified that error appears in the above-identified patent and that said Letters Patent is hereby corrected as shown below:

On the Title Page Item (86) "PCT/UA2005/000380" should be --PCT/AU2005/000380--.

Column 3 – Line 50, insert --a-- before "rim portion".

Column 3 – Line 56, replace "a cover" with "the cover".

Column 4 – Line 5, replace "claim 3" with "claim 2".

Column 4 – Line 39, insert --a water storage tailings facility-- before "comprising".

Signed and Sealed this

Eighteenth Day of August, 2009

David J. Kappos

David J. Kappos
*Director of the United States Patent and Trademark Office*